United States Patent [19]

Tax et al.

[11] 4,286,722

[45] Sep. 1, 1981

[54] CONTAINER LOADING CRANE WITH ROTATABLE HOISTING FRAME

[75] Inventors: Hans Tax, Potsdamer Strasse 3, Munich, Fed. Rep. of Germany, 8000; Klaus Hösler, Eichenau, Fed. Rep. of Germany

[73] Assignee: Hans Tax, Munich, Fed. Rep. of Germany

[21] Appl. No.: 48,048

[22] Filed: Jun. 13, 1979

Related U.S. Application Data

[63] Continuation of Ser. No. 810,879, Jun. 28, 1977, abandoned.

[30] Foreign Application Priority Data

Jul. 5, 1976 [DE] Fed. Rep. of Germany ..... 2630182

[51] Int. Cl.[3] ..... B66C 23/00

[52] U.S. Cl. ..... 212/242; 294/67 DA; 294/81 SF; 414/626

[58] Field of Search ..... 414/626; 212/9, 11, 212/14, 40, 41, 125, 242; 294/67 R, 67 DA, 81 SF

[56] References Cited

U.S. PATENT DOCUMENTS

| | | | |
|---|---|---|---|
| 1,976,014 | 10/1934 | Forsythe | 294/67 DA |
| 2,486,479 | 11/1949 | Kennedy | 294/112 X |
| 3,550,788 | 12/1970 | Auzins et al. | 212/125 |
| 3,567,040 | 3/1971 | Thomson | 212/41 X |
| 3,768,668 | 10/1973 | Schukei | 414/626 X |

FOREIGN PATENT DOCUMENTS

| | | | |
|---|---|---|---|
| 644100 | 4/1937 | Fed. Rep. of Germany | 414/626 |

*Primary Examiner*—Leslie J. Paperner

*Attorney, Agent, or Firm*—Toren, McGeady and Stanger

[57] ABSTRACT

The four hoisting cables of a container loading crane which depend from the free end of the crane boom pass axially through a central opening of a turntable mechanism. The upper turntable portion is mounted on the boom and may tilt about a horizontal axis. The lower turntable portion may be moved relative to the upper portion about a vertical axis. The free ends of the hoisting cables extend between two pairs of engaging elements on the lower turntable portion and corresponding two pairs of engaging elements on a container hoisting frame. The pairs of engagement elements at least on the frame are spaced farther apart in the direction of frame elongation than the frame is wide. One engagement element associated with each tension member is a pulley over which the tension member is trained.

14 Claims, 9 Drawing Figures

126
156
138
136
150
144
140
158
162
162
160
166
164
128
132
168
142
146

CONTAINER LOADING CRANE WITH ROTATABLE HOISTING FRAME

This is a continuation of application Ser. No. 810,879 filed on June 28, 1977, now abandoned.

This invention relates to container loading cranes, and particularly to cranes on which a container hoisting frame may be turned about a vertical axis while suspended from cables or other tension members.

In a known crane of the type described, the lower portion of a turntable mechanism is mounted fixedly on the container hoisting frame, the upper portion of the mechanism is suspended from cables, and a drive motor permits the two portions of the mechanism to be turned relative to each other about a vertical axis.

A container often has to be lowered into or raised from a space which is not significantly wider than the container or the hoisting frame attached thereto. The width of the frame and of the conventional turntable mechanism thus must not exceed the width of the container in any angular position of the frame. Even if the upper portion of the turntable mechanism is suspended from several cables, the lower ends of the cables are closely juxtaposed on the narrow turntable mechanism and do not provide the stability usually available from container hoisting arrangements in which four hoisting cables are attached to the hoisting frame near the four corners of the frame. Regardless of the number of cables upwardly connecting the upper portion of the known turntable mechanism to the supporting structure of the crane, tilting of an eccentrically loaded container cannot be prevented and the resulting uneven tensioning of the several hoisting cables is not conveniently compensated by selectively shortening the cables because the distribution of the container load among the several cables is changed as the position of the hoisting frame changes.

It is a primary object of this invention to provide a crane in which a suspended container may be turned about a vertical axis, but is less likely to tilt under an eccentrically distributed load.

With this and other objects in view, this invention, in one of its aspects, resides in an improvement of a container loading crane which includes a plurality of elongated tension members, hereinafter referred to as cables, depending from the supporting crane structure, and winches which permit the effective, depending lengths of the cables to be varied. The cables are secured to a horizontally extending, elongated container hoisting frame which carries standardized connectors for rigidly fastening a shipping container of standard dimensions to the frame, the frame and container being raised and lowered in response to the varying length of each tension member.

According to this invention, an upper turntable assembly is mounted on the supporting crane structure for tilting movement about a horizontally extending axis. A lower turntable assembly depends from the upper assembly, and a drive motor permits the lower turntable assembly to be turned about a vertically extending axis. The two turntable assemblies define respective portions of a vertical passage through which the cables extend. A first securing device on the lower turntable assembly and a second securing device on the hoisting frame are associated with each of the cables and secure respective longitudinal parts of the associated cable to the lower turntable assembly and to the hoisting frame.

Because the turntable arrangement of the invention is vertically separated from the hoisting frame and the container by parts of the several cables, the turntable arrangement may be dimensioned independently of the narrow space in which the supported container may have to be fitted, and the cables may be fastened to the hoisting frame in places much farther apart than the width of the frame.

Other features, additional objects, and many of the attendant advantages of this invention will readily be appreciated from the following detailed description of prior art cranes and cranes of this invention when considered in connection with the appended drawing in which.

Figure 1:
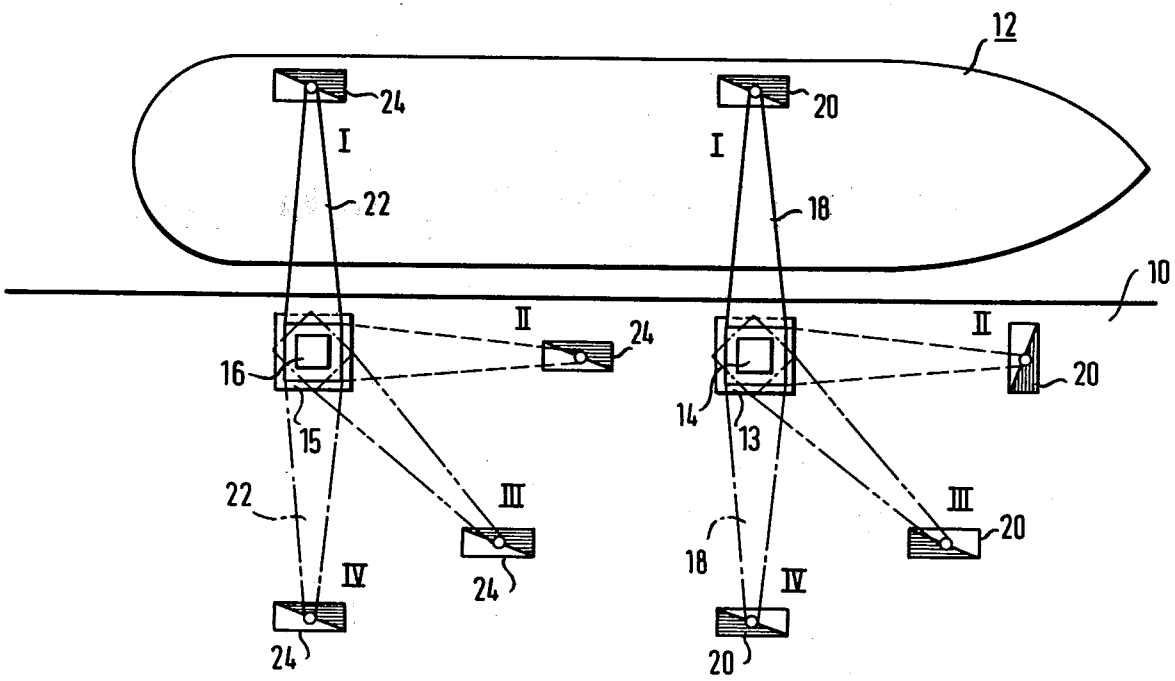
FIG. 1 shows cranes equipped according to this invention in a top plan view of a harbor installation.

Referring initially to FIG. 1, there is seen a pier 10 at which a containership 12 is moored. The upright towers of frames 13, 15 of two cranes stand near the water's edge and carry respective booms 18, 22 that may be swung in a horizontal plane through an angle of 180° from the fully drawn positions through positions indicated in broken lines. Winches 14, 16 atop the two crane towers 13, 15 permit containers 20, 24 to be lifted from the ship 12 and stacked on the pier 10 on other containers already present there. The illustrated containers have top faces painted in two contrasting colors, the two colored fields of each top wall being separated by a diagonal of the elongated, rectangular top face.

If the container 20 shown on the ship 12 in position I is to be stacked on the containers 20 in positions II or IV, the boom 18 needs to be swung 90° and 180° respectively on the crane tower 13, but no angular movement of the container relative to the boom 18 is necessary. For stacking the container shown in position I on the container 20 in position III, it is necessary to turn the container while supported on the boom 18. Similarly, the container 24 shown on the ship 12 in position I needs to be turned about a vertical axis on the boom 22 for deposition in proper alignment with each of the containers 24 in positions II, III, and Iv.

Figure 3:
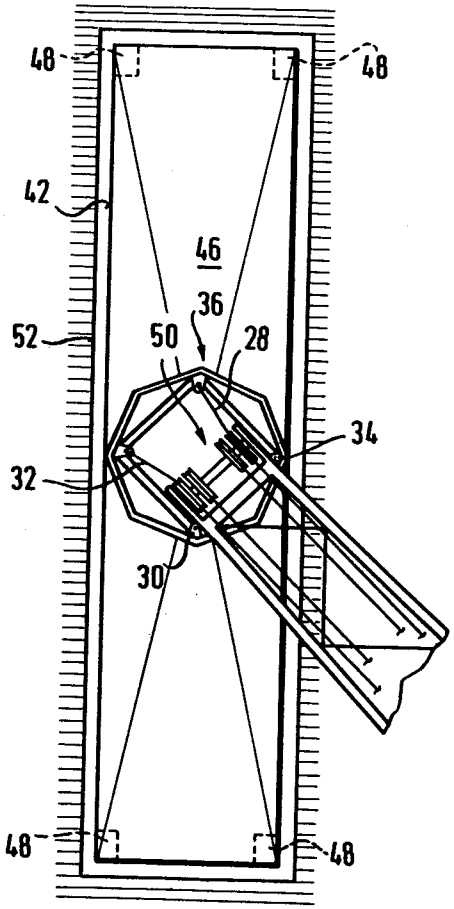
Fig. 3 PRIOR ART
FIG. 3 is a top plan view of the apparatus of FIG. 2 and of portions of a ship being loaded.
Figure 2:
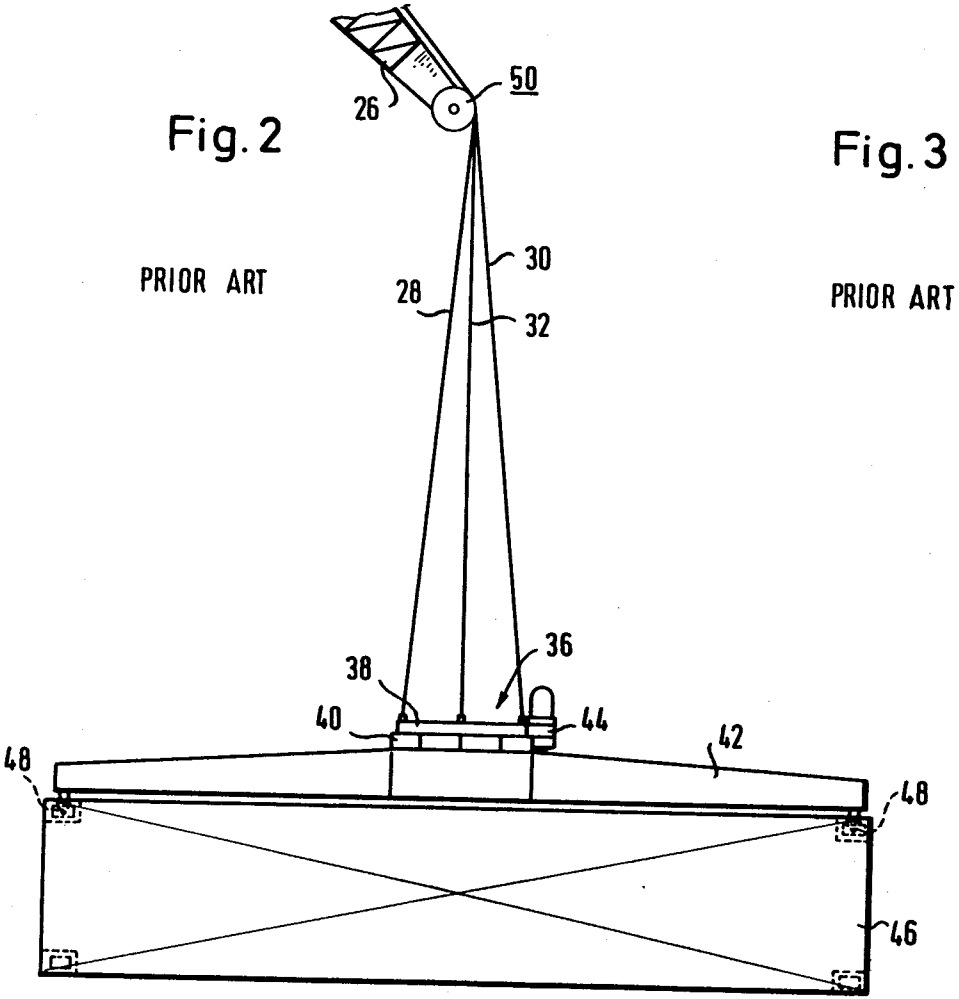
Fig. 2 PRIOR ART
FIG. 2 shows relevant portions of a known crane and of a load suspended therefrom in an elevational view.

A prior art arrangement for turning a suspended container 46 about a vertical axis is shown in FIGS. 2 and 3. The supporting structure of the crane is represented in FIG. 2 only by the free end 26 of the boom from which four hoisting cables 28, 30, 32, 34 depend, the cable 34 being obscured in the view of FIG. 2 by the cable 32. An octagonal upper member 38 of a turntable mechanism 36 is suspended from the four cables. The lower member 40 of the mechanism is a ring which may be turned about the vertical axis of the mechanism 36 by a motor 44 and engaged gears (not shown). The ring 40 is fixedly fastened to the central portion of a container hoisting frame 42 whose four corners carry standardized automatic connectors engaged with mating receptacles 48 in the four top corners of the shipping container 46.

The four cables 28, 30, 32, 34 are trained over respective coaxial pulleys 50 at the free end 26 of the boom and are fastened to respective cable drums, not specifically illustrated, in the winches shown at 14,16 in FIG. 1.

The illustrated, known container hoisting arrangement must be capable of withdrawing individual containers from between other containers in a stack and of depositing a container deep in a ship's hold through an opening barely sufficient to pass the container. Such an opening is shown at 52 in FIG. 3. The container hoisting frame 42 and the turntable mechanism 36 must descend into the ship's hold together with the container 46, and the turntable mechanism, therefore, must fit into a cylindrical space whose axis is upright and whose diameter is no greater than the width of the container or the equal width of the frame 42.

The ends of the cables 28, 30, 32, 34 attached to the upper turntable member 38 are closely bunched together for this reason, and a container load whose center of gravity is not in the longitudinal mid-portion of the container, causes the container to tilt because the cables are somewhat resilient and yield differently to different applied stresses. If a cable stretched by a preferentially applied load is shortened by the amount of excess stretch, some of the load is transferred from the shortened cable to other cables which in turn are stretched thereby. The righting of a tilted container suspended from the known turntable arrangement thus may require several steps of a trial-and-error procedure.

The cranes of the invention, shown in FIGS. 4 to 9 only as far as they differ from the prior art, avoid these problems.

Figure 4:
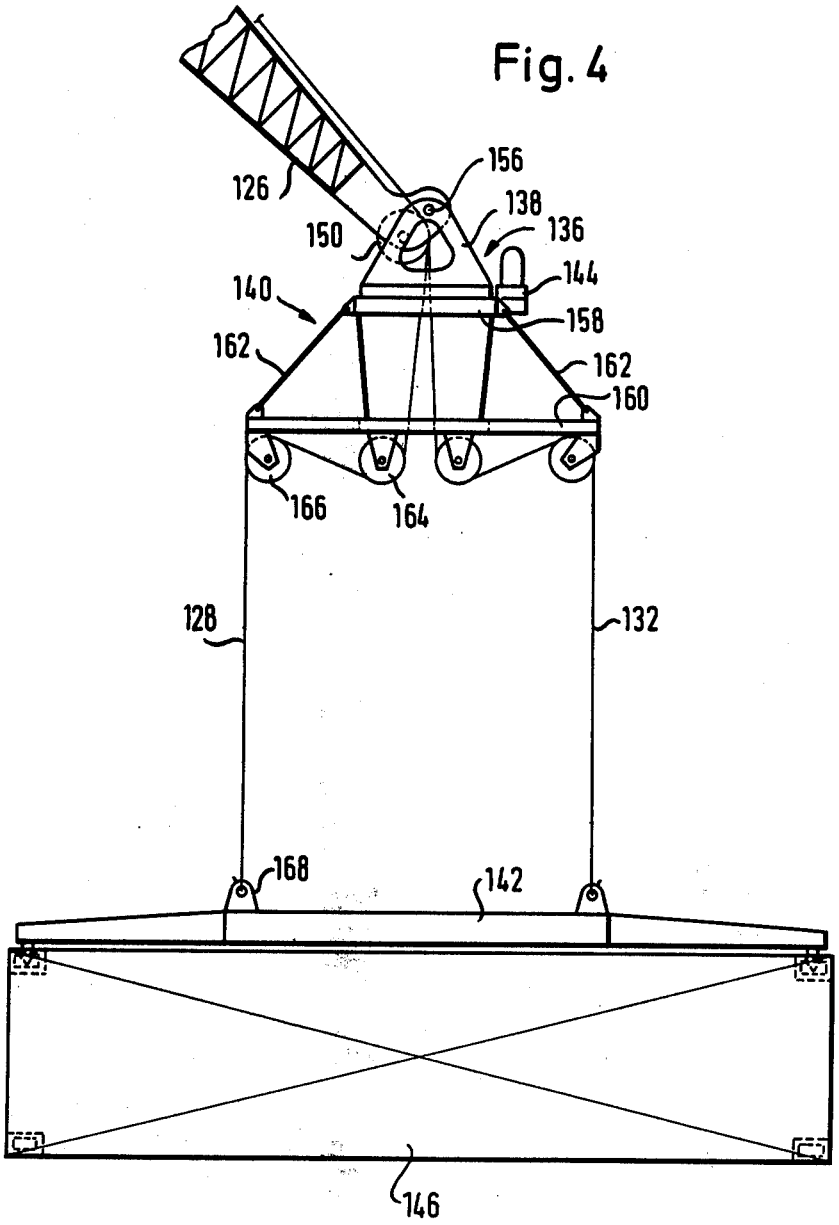
FIG. 4 shows a crane of the invention and a suspended load in fragmentary elevation.
Figure 5:
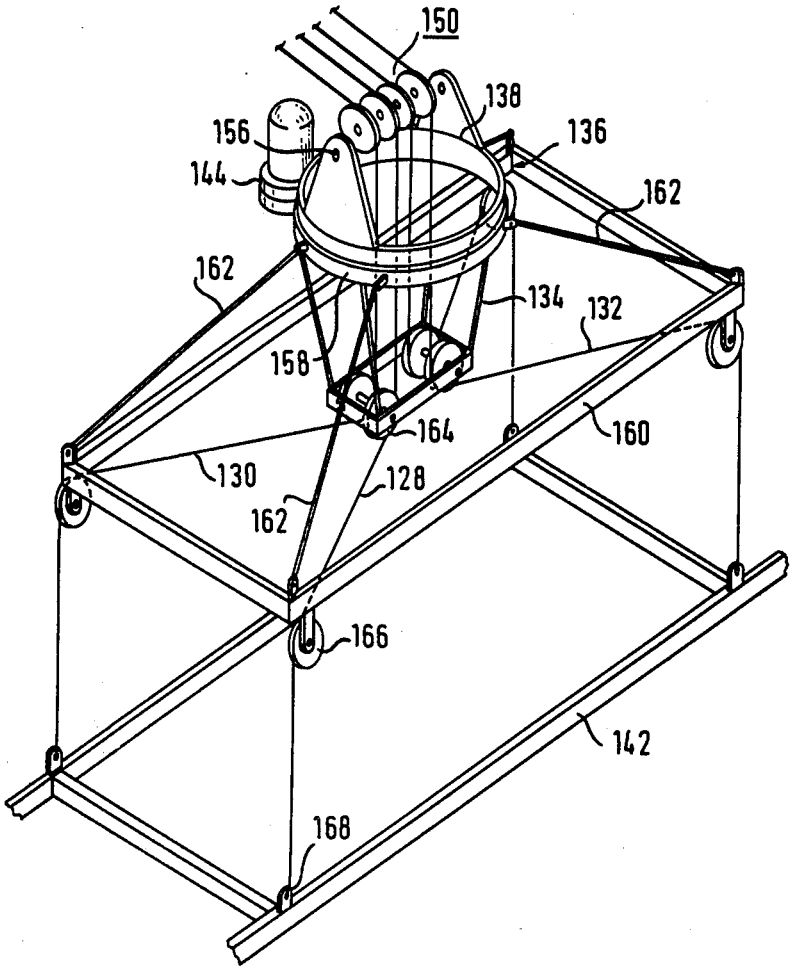
FIG. 5 is a perspective view of elements of the apparatus of FIG. 4.

In the first embodiment of the invention shown in FIGS. 4 and 5, the free boom end 126 carries four pulleys 150, and an assembly 138 suspended from a horizontal pivot shaft 156. The assembly 138 which cannot turn about a vertical axis is the upper part of the turntable mechanism 136 whose lower part 140 includes a ring 158 that may be turned about the vertical axis of the mechanism 136 by a motor 144. Four cables 162 diverge obliquely downward from respective circumferentially spaced portions of the ring 158 to the four corners of a horizontal, rectangular carrier frame 160. The ring 158, cables 162, and carrier frame 160 constitute an assembly which is rigid under all normal operating stresses, and becomes even more rigid if the crane lifts a load.

The four hoisting cables 128, 130, 132, 134 extend downward from the pulleys 150 in substantially parallel, vertical paths through a central, axial passage in the turntable assemblies 138, 140 to four guide pulleys 164 fastened to the ring 158 by a supporting frame at approximately the level of the carrier frame 160. The cables are then trained over respective pulleys 166 on the four corners of the carrier frame 160, and their free ends thence extend vertically downward in practically parallel alignment to fastening lugs 168 on the hoisting frame 142 which are spaced from each other longitudinally of the frame 142 a distance much greater than the width of the frame 142.

In the crane partly shown in FIGS. 4 and 5, the pulleys 164 primarily change the directions of the hoisting cables. The pulleys 166 transmit much of the load from the cables to the carrier frame 160, and the fastening lugs 168 transmit the load of the container 146 and the hoisting frame 142 to the cables. The lugs 168 and the pulleys 166 may be interchanged without basic change in the mode of operation, and guide pulleys may additionally be provided as needed to maintain a desired path of movement for the cables.

Figure 7:
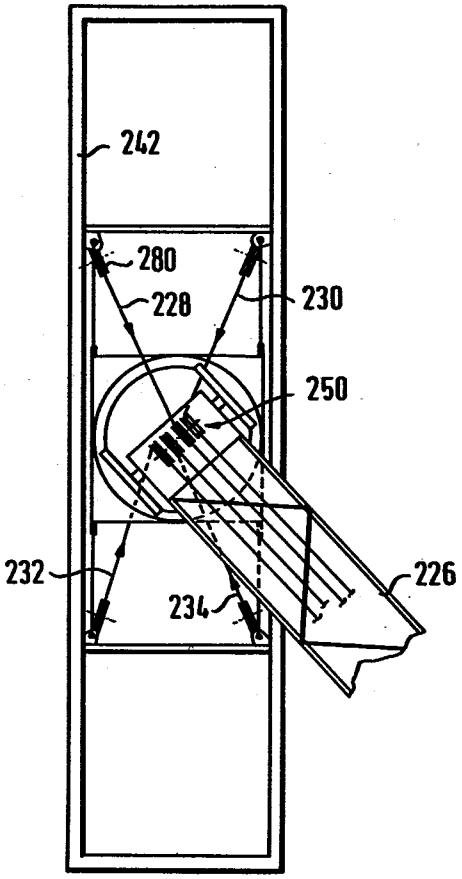
FIG. 7 shows a portion of the crane of FIG. 6 in top plan view.
Figure 6:
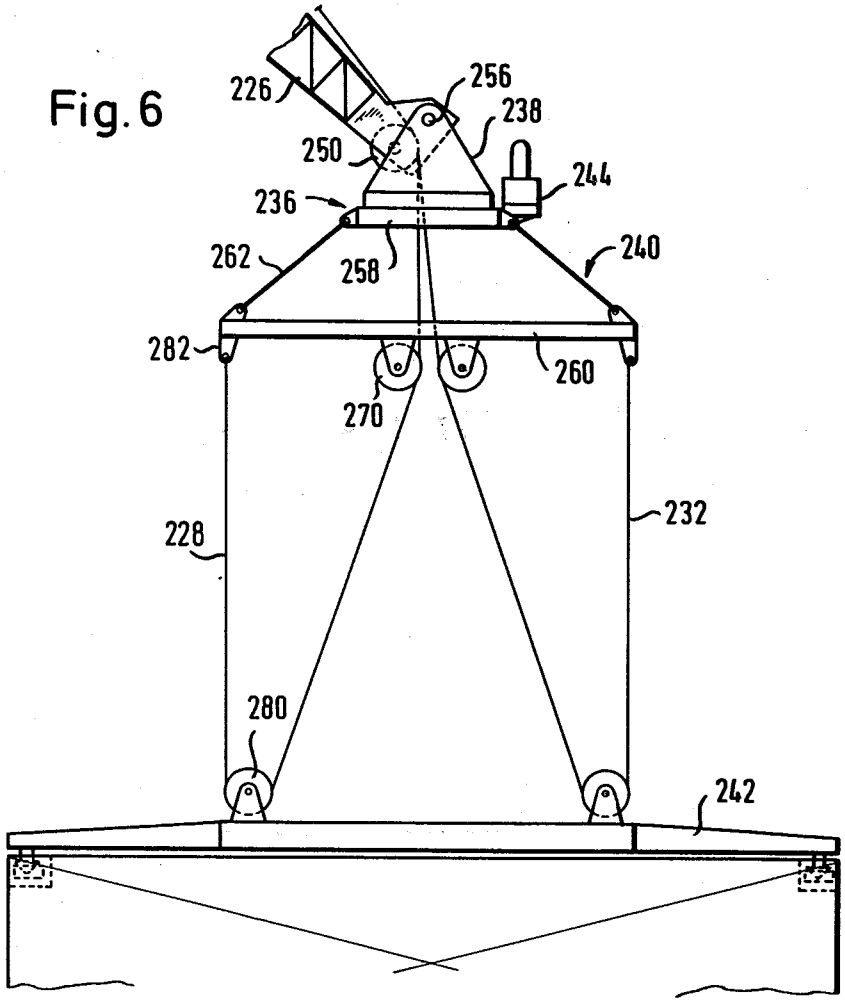
FIG. 6 illustrates another crane of the invention in the manner of FIG. 4.
Figure 8:
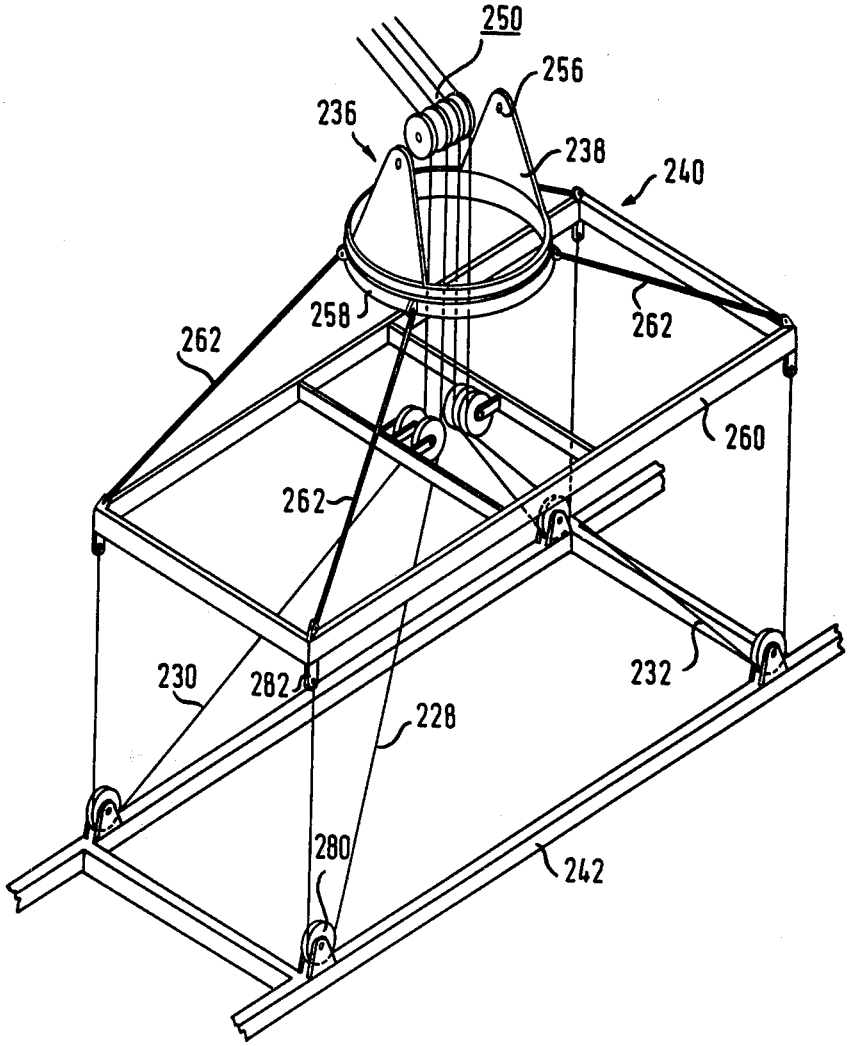
FIG. 8 is a perspective view of the apparatus of FIG. 7.

In the second embodiment of the invention illustrated in FIGS. 6, 7, and 8, reference numerals designating elements corresponding to those shown in FIGS. 4 and 5 have been augmented by 100, and several corresponding elements will not be described again.

The four cables 228, 230, 232, 234 are trained from the pulleys 250 on the boom 226 over guide pulleys 270 on the carrier frame 260 obliquely downward to load-transmitting pulleys 280 on the hoisting frame 242 from which the free ends of the cables rise vertically to fastening lugs 282 on the four corners of the carrier frame 260.

Figure 9:
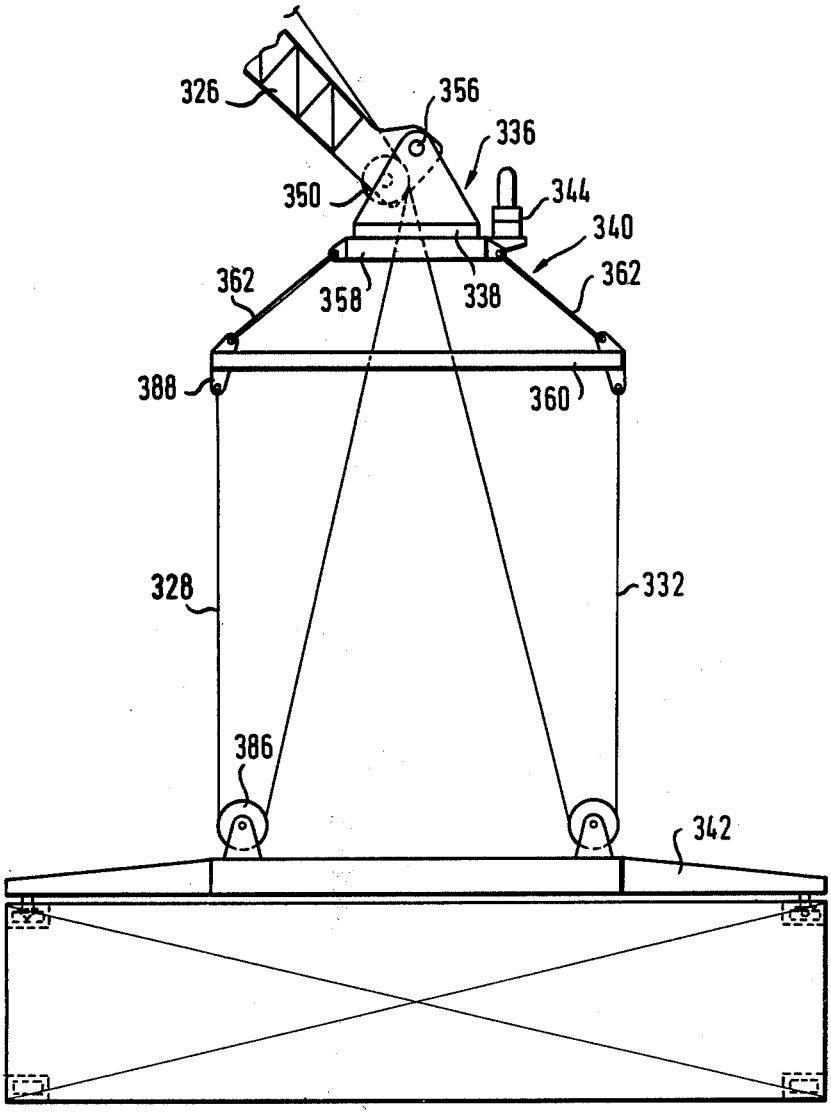
FIG. 9 shows yet another crane of the invention in a view corresponding to those of FIGS. 4 and 6.

Reference numerals further augmented by 100 are used in FIG. 9 for designating corresponding elements of a partly illustrated crane which basically differs from that shown in FIGS. 6 to 8 by the absence of cable deflecting guide pulleys on the carrier frame 360. The four hoisting cables, of which only the cables 328, 332 are visible in FIG. 9, extend from the pulleys 350 straight to load-transmitting, reversing pulleys 386 on the hoisting frame 342, and the free ends of the cables are longitudinally secured on the four corners of the carrier frame 360 by fastening lugs 388.

In both the last-described embodiments of the invention, the cables diverge from pulleys on a container hoisting frame upward toward a carrier frame and other elements of a turntable mechanism at small acute angles. In the embodiment illustrated in FIGS. 6 to 8, guide pulleys on the carrier frame 260 permit the hoisting cables to pass through the turntable mechanism in respective path which deviate very little from parallel alignment and thus avoid tangling of the cables if the suspended container is turned through an angle of more than 180°, as is rarely called for. The cables shown in FIG. 9 enclose a significant acute angle and the arrangement illustrated in FIG. 9 while simpler than the others, is preferably not used if a turning angle of more than 180° is to be expected.

In all illustrated embodiments of the invention, the lugs 168 and pulleys 280 and 386 which secure hoisting cables to container hoisting frames 142, 242, 342 have been shown spaced longitudinally of the hoisting frames by more than the hoisting frame width, but by not quite one half of the hoisting frame length. This is adequate for most practical applications since eccentric loading of shipping containers that cannot be compensated by the illustrated longitudinal spacing of the cables on the hoisting frame is rarely encountered. However, the cable securing elements may be spaced even farther apart than is shown in the instant drawing if so desired. Hanging the hoisting frame by its four top corners from a carrier frame is specifically contemplated.

If a container is asymmetrically loaded to such an extent that the two cables attached to one longitudinal end portion of the associated hoisting frame are stretched significantly more than the other two, the resulting, relatively minor tilting of the container may be rectified by shortening the two stretched cables without simultaneously causing significant additional stretching of the two other cables. Many winches now in industrial use permit the necessary relative displacement of the individual cable drums.

The wide spacing of the cable securing elements on the container hoisting frames in the cranes of the invention causes torque to be transmitted from the turntable mechanism to the container hoisting frame with minimal inertial lag, if any, and minimizes angular oscillation of the load about a vertical axis. An inherent advantage of this invention is the close proximity of the drive motors in the turntable mechanisms to the supporting crane structure, and the limited movement of the turntable mechanism as a whole relative to the supporting structure. It is simpler in the cranes of the invention to connect the turntable motors to power supplies and controls of the crane tower than with turntable mechanisms which are suspended from flexible cables.

If it is desired to convert a crane of the invention to service with loads other than standardized shipping containers, the boom is lowered until the container hoisting frame rests on the ground, and the carrier frame rests on the hoisting frame. The two frames may then be released from the hoisting cables and from the cables 162, 262, 362, and hooks or other load engaging elements may be mounted on the free ends of the hoisting cables. The turntable mechanism may be left in place for future use and does not interfere with crane operation in the absence of a container loading frame.

Alternatively, the container hoisting frames may be raised until they lift the carrier frames and abuttingly engage the lower rings 158, 258, 358 of the turntable mechanisms. The pivot shafts 156, 256, 356 may then be withdrawn. Thereafter, the entire turntable mechanism with all elements normally suspended therefrom may be lowered to the ground and removed.

The several pulleys over which the hoisting cables of the invention are trained have been shown to be journaled in brackets fixedly fastened on the carrier frames and hoisting frames. If the inclination of the cables varies greatly with varying distance between the hoisting frame and the turntable mechanism, it may be more advantageous to mount the pulley brackets on the frames by means of pivots in a manner known in itself and not specifically illustrated.

The axis of rotation of the turntable mechanism in the cranes of the invention is usually held in a vertical position by the suspended load. If so desired, a parallelogram linkage or its equivalent may connect the crane tower, the boom, and the turntable mechanism in such a manner that the axis of rotation of the mechanism remains parallel to the tower axis in all positions of the crane boom and regardless of any imbalance in the suspended load. Such a linkage minimizes oscillation of the suspended container about the pivot shaft fastening the turntable mechanism to the free end of the boom.

Other variations of the present invention will readily suggest themselves to those skilled in the art in the light of the above teachings. It should be understood, therefore, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. In a container loading crane including a a base frame, a boom extending from said base frame and having a free end spaced outwardly from said base frame, a plurality of elongated tension members depending from the free end of said boom, winch means mounted on said base frame and said tension members connected to said winch means and extending therefrom to the free end of said boom for varying the effective depending lengths of said tension members, a horizontally extending, elongated container hoisting frame carrying connector means for rigidly fastening a shipping container to said container hoisting frame, each of said tension members being secured to said container hoisting frame for raising and lowering the frame in response to the varying dependent lengths of the tension member, and turning means for turning said container hoisting frame about a vertically extending axis, the improvement in said turning means which comprises:

(a) a first turntable assembly pivotally mounted about a horizontal pivot axis on the free end of said boom and secured thereto against rotation about the vertically extending axis;

(b) a second turntable assembly mounted on said first turntable assembly for rotation about the vertical extending axis assembly;

(c) drive means for turning said second turntable assembly relative to said first turntable assembly and the free end of said boom about said vertically extending axis, (1) said turntable assemblies defining respective portions of a vertical passage therethrough, (2) said tension members extending through said passage;

(d) first securing means on said second turntable assembly and second securing means on said hoisting frame associated with each of said tension members and securing respective, longitudinal parts of the associated tension member to said second turntable assembly and to said hoisting frame;

(e) said first and second turntable assemblies being fixed in the vertical direction with respect to said horizontal pivot axis; and (f) said plurality of tension members being twisted about said vertically extending axis when said second turntable assembly is rotated with respect to said first turntable assembly.

2. In a crane as set forth in claim 1, the second securing means associated with two of said tension members being spaced longitudinally of said hoisting frame a distance greater than the horizontal width of said hoisting frame.

3. In a crane as set forth in claim 2, the first securing means associated with said two tension members being spaced on said second turntable assembly longitudinally of said hoisting frame a distance greater than the horizontal width of said hoisting frame.

4. In a crane as set forth in claim 3, said two tension members having respective free end portions extending between the associated first and second securing means in substantially parallel alignment.

5. In a crane as set forth in claim 1, said tension members extending through said passage in at least approximately parallel alignment.

6. In a crane as set forth in claim 1, said second turntable assembly including a turntable member contiguously adjacent said first turntable assembly and a carrier member spacedly suspended from said turntable member and carrying said first securing means.

7. In a crane as set forth in claim 6, suspending means connecting said carrier member to said turntable member and substantially completely preventing relative angular movement of said carrier member relative to said turntable member about said vertically extending axis while a shipping container is fastened to said hoisting frame and said hoisting frame is being raised by said tension members.

8. In a crane as set forth in claim 1, one of said first and second securing means associated with each of said tension members including a pulley member, the associated tension member being trained over said pulley member, the other one of said associated first and second securing means being fastened to a free end portion of the associated tension member.

9. In a crane as set forth in claim 8, said one securing means being said second securing means.

10. In a crane as set forth in claim 9, a guide pulley on said second turntable assembly associated with each of said tension members, each tension member being trained sequentially over said guide pulley and the pulley member of said second securing means, respective longitudinal parts of each tension member diverging from the associated pulley member toward the associated guide pulley and first securing means.

11. In a crane as set forth in claim 8, said one securing means being said first securing means.

12. In a crane as set forth in claim 11, a guide pulley on said second turntable assembly associated with each of said tension members, each tension member being trained sequentially over said guide pulley and said pulley member of said first securing means to the associated second securing means.

13. In a crane as set forth in claim 1, said boom being horizontally extending, said tension members extending from said winch means on said base frame longitudinally of said boom to said free end and depending from said free end.

14. In a crane as set forth in claim 13, said base frame comprising an upright frame, and said boom being pivotally secured to said frame.

* * * * *